US011027901B2

(12) United States Patent
Davis et al.

(10) Patent No.: US 11,027,901 B2
(45) Date of Patent: Jun. 8, 2021

(54) TRANSFER LID

(71) Applicant: NEOMED, INC., Woodstock, GA (US)

(72) Inventors: Benjamin Martin Davis, Woodstock, GA (US); Aaron N. Ingram, Canton, GA (US); Mark M. Costello, County Mayo (IE); Tony Doherty, County Mayo (IE); John Burke, County Roscommon (IE)

(73) Assignee: NeoMed, Inc., Woodstock, GA (US)

( * ) Notice: Subject to any disclaimer, the term of this patent is extended or adjusted under 35 U.S.C. 154(b) by 303 days.

(21) Appl. No.: 14/844,910

(22) Filed: Sep. 3, 2015

(65) Prior Publication Data

US 2016/0067147 A1 Mar. 10, 2016

Related U.S. Application Data

(60) Provisional application No. 62/047,269, filed on Sep. 8, 2014.

(51) Int. Cl.

| | |
|---|---|
| ***B65D 55/16*** | (2006.01) |
| ***B65D 47/32*** | (2006.01) |
| ***B65D 47/14*** | (2006.01) |
| ***B65D 51/16*** | (2006.01) |
| *A61J 9/00* | (2006.01) |

(52) U.S. Cl.

CPC ..... *B65D 55/16* (2013.01); *B65D 47/141* (2013.01); *B65D 47/32* (2013.01); *B65D 51/1622* (2013.01); *A61J 9/00* (2013.01)

(58) Field of Classification Search

CPC ... A61J 9/00; A61J 9/04; A61J 11/008; B65D 47/141; B65D 51/1622; B65D 55/16

See application file for complete search history.

(56) References Cited

U.S. PATENT DOCUMENTS

| | | | | |
|---|---|---|---|---|
| 2,434,612 | A | 1/1948 | Hamiel | |
| 3,147,876 | A * | 9/1964 | Lepore | B65D 51/1622 215/261 |
| 3,545,637 | A | 12/1970 | Barr | |
| 3,645,262 | A | 2/1972 | Harrigan | |
| 3,735,888 | A | 5/1973 | Jacko | |
| 5,297,688 | A * | 3/1994 | Beck | B65D 41/0421 215/343 |
| 5,853,096 | A * | 12/1998 | Bartur | B65D 51/1688 215/261 |
| RE42,910 | E * | 11/2011 | Pearce | B65D 51/1688 215/235 |
| 8,100,854 | B2 | 1/2012 | Vogelin et al. | |
| 8,464,882 | B2 | 6/2013 | Tirosh | |
| 8,967,405 | B2 | 3/2015 | Morrone | |
| 2005/0258125 | A1 | 11/2005 | Kiehne | |
| 2007/0138121 | A1 * | 6/2007 | Stribling | A47G 19/2272 215/11.4 |
| 2012/0065608 | A1 * | 3/2012 | Costello | A61J 9/00 604/403 |

(Continued)

*Primary Examiner* — Steven A. Reynolds
*Assistant Examiner* — Javier A Pagan
(74) *Attorney, Agent, or Firm* — Dority & Manning, P.A.

(57) ABSTRACT

A transfer lid for a fluid container, having an attachment collar for removably attaching the transfer lid to the fluid container, and an inner collar arranged generally concentrically with and spaced inwardly from the attachment collar, the inner collar having a vent opening such as a vent slot extending therethrough.

19 Claims, 6 Drawing Sheets

(56) References Cited

U.S. PATENT DOCUMENTS

| | | | | |
|---|---|---|---|---|
| 2012/0315353 | A1* | 12/2012 | Becsi | A61J 9/00 426/2 |
| 2013/0030379 | A1* | 1/2013 | Ingram | A61M 5/162 604/218 |
| 2015/0129535 | A1 | 5/2015 | Morrone, III | |

* cited by examiner

TRANSFER LID

CROSS-REFERENCE TO RELATED APPLICATION

This application claims the benefit of U.S. Provisional Patent Application Ser. No. 62/047,269 filed Sep. 8, 2014, the entirety of which is hereby incorporated herein by reference for all purposes.

TECHNICAL FIELD

The present invention relates generally to the field of containment, storage and delivery of fluids, and more particularly to a transfer lid for an enteral fluid container such as a bottle or breast pump collection container providing vented transfer of fluids such as formula or breast milk to or from the container.

BACKGROUND

Various containers are used for collection, storage and delivery of enteral fluids such as breast milk, formula, medications, supplements and the like. For example, breast milk may be collected in a collection container of a breast pump, transferred to a storage container for storage, and/or transferred to a bottle or syringe for feeding an infant, for example, orally via a bottle nipple or enterally via a feeding tube or line.

Maintaining sanitary and aseptic conditions in the handling of such enteral fluids is desirable. Various fluid collection, storage and delivery container systems have been developed. For example, U.S. Pat. App. Pub. US2012/0289936A1 by Ingram et al, which is incorporated herein by reference, shows an example system for aseptic collection and enteral delivery of fluids.

Continued improvements to collection, storage and delivery containers and systems are sought. It is to the provision of an improved transfer lid for such containers, and to containment systems incorporating such a transfer lid that the present invention is primarily directed.

SUMMARY

In example embodiments, the present invention provides an improved transfer lid or cap for bottles, breast pump collection containers, and other containers. In further embodiments, the present invention provides improved containers, containment systems, and methods, incorporating such a transfer lid.

In one aspect, the present invention relates to a transfer lid for a fluid container, the transfer lid preferably including an attachment collar for removably attaching the transfer lid to the fluid container, and an inner collar arranged generally concentrically with and spaced inwardly from the attachment collar, the inner collar having a vent opening extending therethrough.

In another aspect, the invention relates to a fluid containment and transfer system. The fluid containment and transfer system preferably includes a containment shell defining a contained volume therein, and having an opening accessing the contained volume and a threaded coupling around the opening. The fluid containment and transfer system preferably also includes a transfer lid having a top panel, an attachment collar for releasable engagement with the threaded coupling of the containment shell to allow attachment and removal of the transfer lid from the containment shell, an inner collar, a vent slot extending through at least a portion of the inner collar, and a fluid transfer port through the top panel for transfer of fluid through the transfer lid into and out of the contained volume of the containment shell.

In still another aspect, the invention relates to a breast milk containment and transfer system. The breast milk containment and transfer system preferably includes a breast milk pump collection container having a threaded rim and defining a contained volume. The breast milk containment and transfer system preferably also includes a transfer lid having a top panel, an attachment collar for releasable engagement with the threaded rim of the breast milk pump collection container to allow attachment and removal of the transfer lid from the breast milk pump collection container, an inner collar, a vent slot extending through at least a portion of the inner collar, and a fluid transfer port through the top panel for transfer of fluid through the transfer lid into and out of the contained volume of the breast milk pump collection container.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
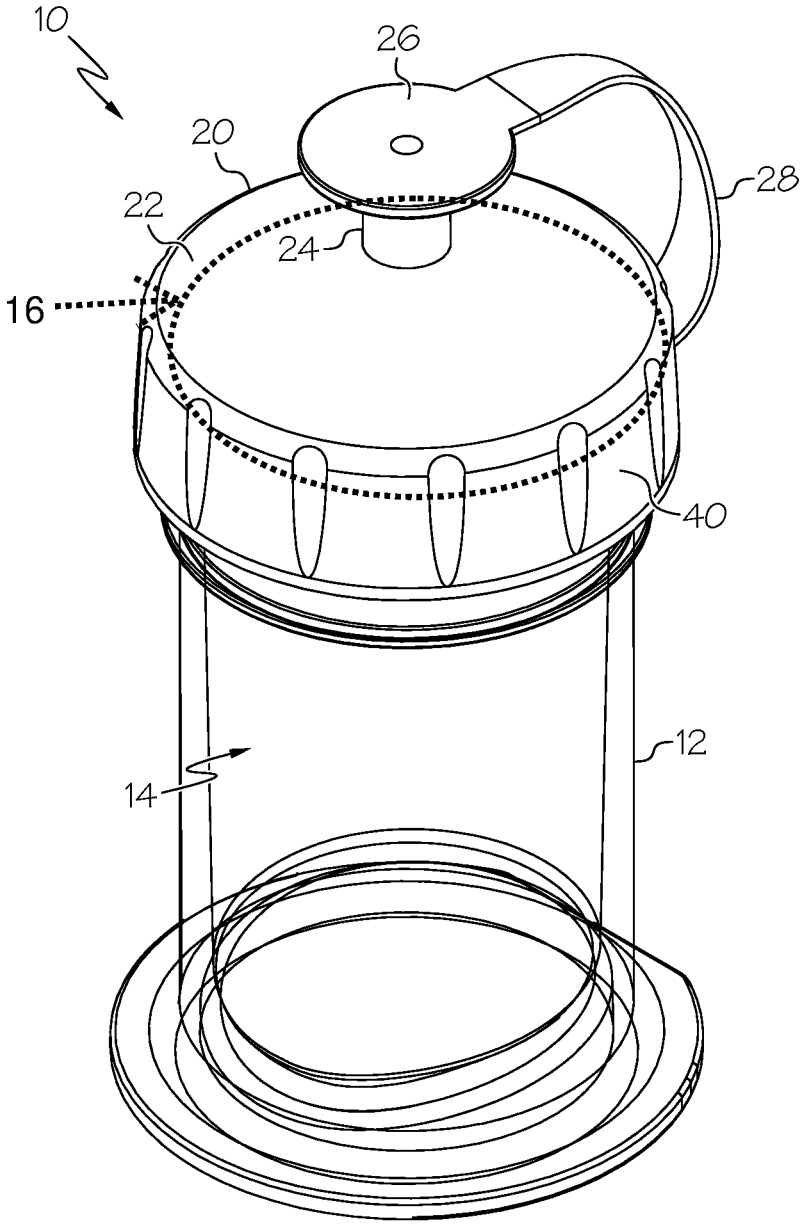
FIG. 1 is a perspective view of a container with a transfer lid or cap according to an example embodiment of the present invention, with the lid cap in a closed state.
Figure 2:
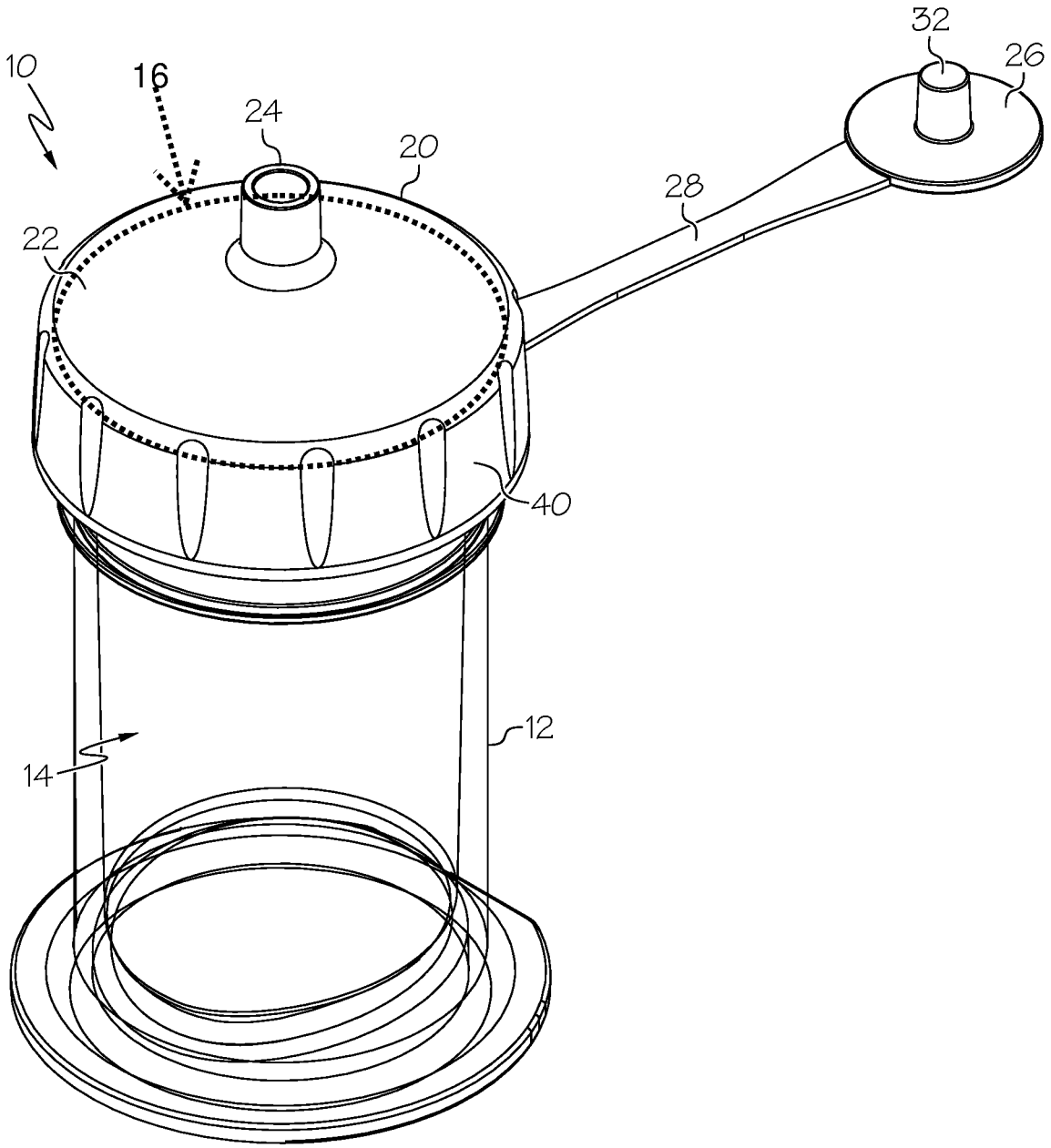
FIG. 2 is a perspective view of the container and transfer lid of FIG. 1, with the lid cap in an open state.

With reference now to the drawing figures, wherein like reference numbers represent corresponding parts throughout the several views, FIGS. 1 and 2 show a container 10, comprising a containment shell 12 enclosing a contained volume 14 for containment of fluids. The containment shell 12 has a rim 16. In example embodiments, the container 10 is a breast milk pump collection container, a feeding bottle for preparation and delivery of formula to an infant, a storage container for enteral fluids such as formula or milk, or any of a variety of other container formats.

Figure 3:
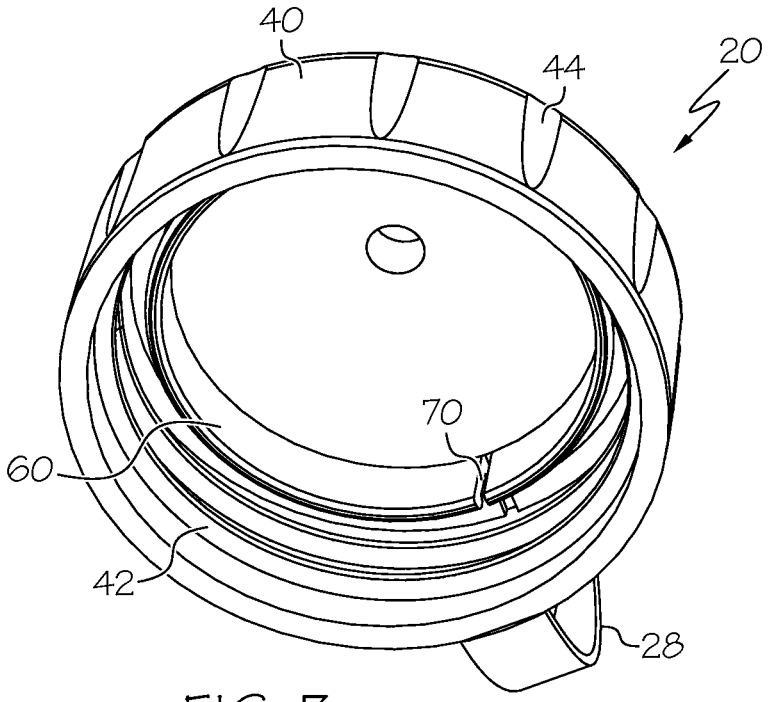
FIG. 3 is a bottom perspective view of the transfer lid shown in FIG. 1.
Figure 4:
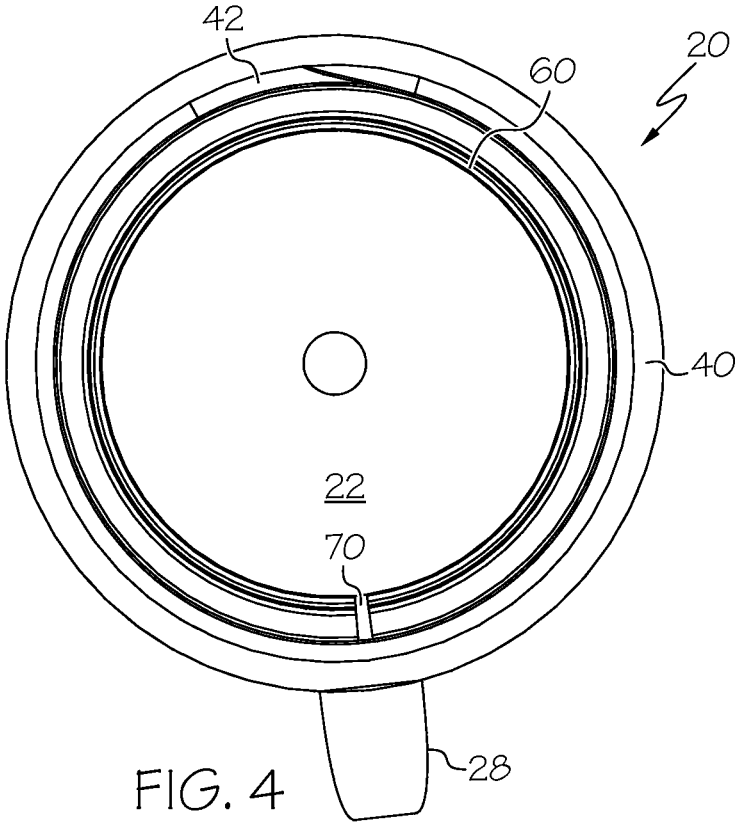
FIG. 4 is a bottom plan view of the transfer lid shown in FIG. 1.
Figure 5:
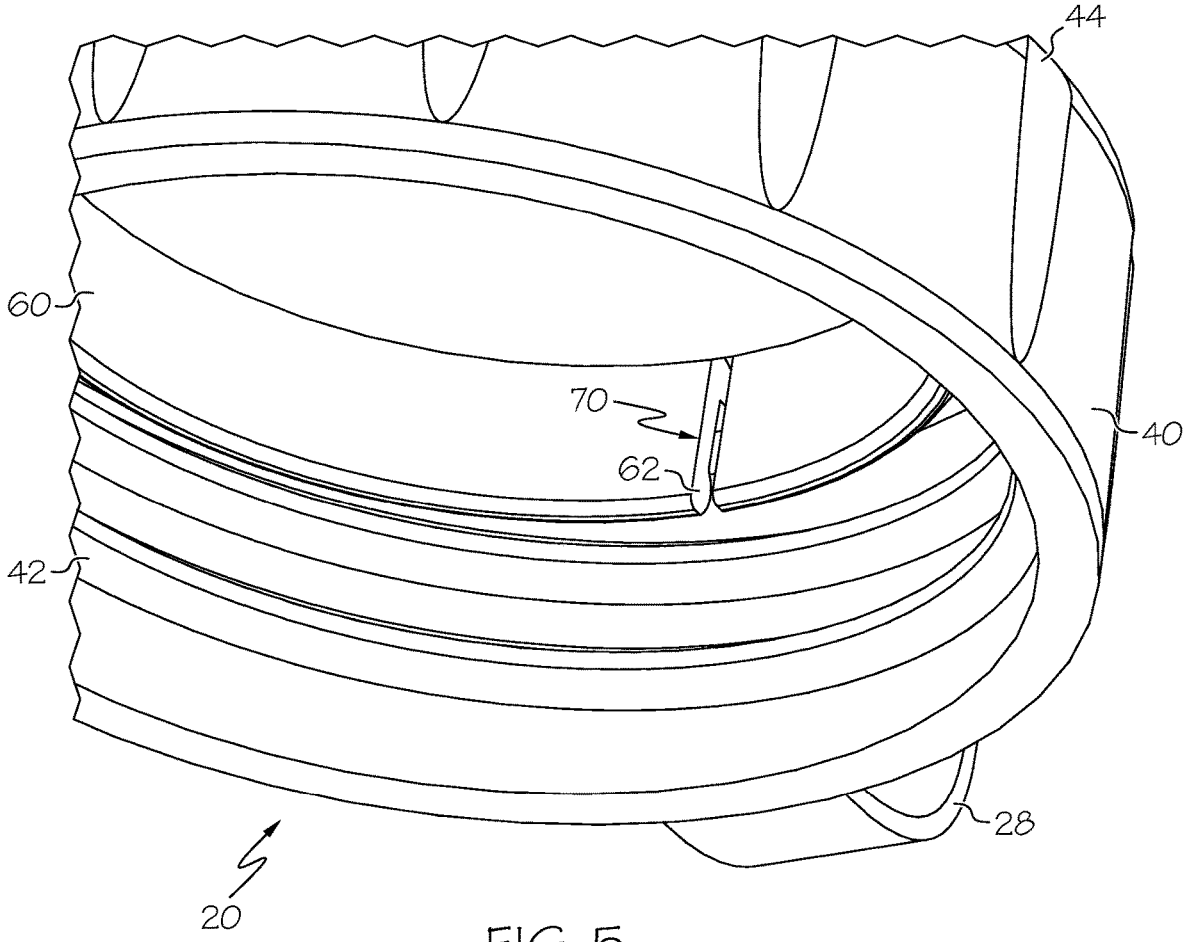
FIG. 5 is close up view of a vent slot portion in the bottom of the transfer lid.

The containment shell 12 includes a threaded open top terminating in a rim 16, to which a vented transfer lid or cap 20 is removably mounted to enable selective opening and closing of the container for delivery of fluids to and from the contained volume 14. In the example embodiment depicted in FIGS. 3-5, the transfer lid 20 comprises a generally circular top panel 22 with a transfer port or nipple 24 extending from a generally central position on the top panel outwardly in a first or distal direction. Optionally, a port closure cap 26 is attached to the transfer lid 20 by a tether 28, and includes a cover or plug 32 for removable engagement and closure of the transfer port 24. The transfer lid 20 further comprises an attachment collar 40 extending in a second or proximal direction from the top panel 22.

In example forms, the transfer port 24 comprises an enteral-only (EO) coupling, for example an EO female coupling for releasable sealing engagement with a male EO coupling of a transfer syringe for transferring enteral fluids to and/or from the container 10. Optionally, the transfer port 24 comprises a self-sealing closure to allow fluid passage to or from a syringe inserted therein, but to prevent fluid leakage from the container and provide an air-tight seal forming an aseptic closure to prevent contamination from entering the container when the syringe is removed. Optionally, the sealing closure of the transfer port provides a positive sealing engagement with the cooperating coupling element of a transfer syringe, to prevent airflow, fluid leakage or potential transfer of contamination therebetween into or from the container. In further example embodiments, the transfer port 24 is optionally an enteral-only coupling compatible with the ENFit design standard (ISO 80369-3).

The interior circumferential face of the attachment collar 40 of the transfer lid 20 is threaded, to releasably engage corresponding exterior threads at the top of the containment shell 12 near the rim around its open upper end. The threads 42 and attachment collar are optionally configured for engagement with the threads of a containment shell compatible with the threaded connection hub of a standard breast pump. Various collar and thread configurations may be provided within the scope of the invention, for compatibility with different breast pump and/or other product designs and different manufacturer specifications. The exterior circumferential face of the attachment collar 40 of the transfer lid 20 optionally comprises spaced recesses, ridges or other gripping features 44 to assist a user in installing and removing the transfer lid onto and from the containment shell 12. In this manner, the containment shell 12 can be attached to a breast pump for collection of breast milk, then removed from the pump and the transfer lid 20 attached to the containment shell to close the container 10 for storage or dispensing of the milk. Alternatively, the transfer lid 20 can be removed from the container 10 to allow artificial formula, supplements or other fluids to be prepared through the open top of the containment shell, and the transfer lid replaced for storage and dispensing.

A circumferential sealing flange or inner collar 60 projects from the top panel 22 of the transfer lid 20 in the second or proximal direction, generally concentric with and spaced a distance inwardly from the attachment collar 40. The outside diameter of the inner collar 60 is less than the inside diameter of the attachment collar 40 by a dimension selected to define a spacing between the attachment collar and the inner collar corresponding to the material thickness of the containment shell 12 around its upper rim. In this manner, when the transfer lid 20 is attached to the containment shell 12, the upper rim of the containment shell is engaged between the inner circumferential face of the attachment collar on the outside of the containment shell, and the outer circumferential face of the inner collar 60 on the inside of the containment shell, with a close fit therebetween. The free end 62 of the inner collar 60 opposite its attachment to the top panel 22 preferably comprises a radiused or tapered profile to provide a smoother interface as the rim of the containment shell 12 passes along the inner collar during installation and removal. Optionally, the material of the inner collar 60 is sufficiently thin and resilient to allow a degree of flexure or inward compression upon contact with the rim of the containment shell 12 for easier installation and removal of the transfer lid 20, and/or a small outwardly radiused bulb profile along the outside diameter of the inner collar around its free end 62 forms a sealing contact ring about the rim of the containment shell.

A narrow vent opening, such as a vent slot 70 is provided through the inner collar 60 and along the inside surface of the top panel 22 of the transfer lid 20. The slot 70 allows air to vent to or from the contained volume 14 of the container 10, for example as fluid is delivered into or out of the container through the transfer port 24, and/or as temperature changes may cause fluid expansion or contraction within the contained volume. For example, in the event a substantially airtight seal is formed between the transfer port of the container 10 and a transfer syringe, pressure or vacuum within the contained volume may render fluid transfer between the container and the syringe difficult, absent the provision of a vent to allow airflow out of or into the contained volume to relieve the pressure or vacuum otherwise resulting from fluid delivery to or from the contained volume by the syringe.

Preferably the vent slot 70 is configured to define a sufficiently narrow opening width such that leakage of liquid from the contained volume therethrough is minimized or prevented, but providing a passage large enough to allow airflow therethrough sufficient to accommodate normal rates of transfer of the contained liquid through the transfer port 24. In example forms, the slot 70 has an opening width of about 0.25 mm to about 1.0 mm, for example about 0.40 mm or about 0.50 mm. Additionally, the vent slot 70 is preferably positioned along or adjacent the inner face of the top panel 22 of the transfer lid 20, such that any liquid leaking through the vent slot will remain contained between the threads 42 of the transfer lid and the interengaging threads of the containment shell 12 during normal use of the container 10.

In alternate embodiments, the vent opening can comprise one or more holes, channels, lumens, gaps, apertures or other opening(s) or passage(s) instead of or in addition to a slotted configuration.

In the depicted embodiment, the vent slot 70 extends generally vertically or perpendicular to the top panel 22 through the entire height of the inner collar 60, and generally radially along the inner face of the top panel 22 from the inside diameter of the inner collar to the inside diameter of the attachment collar 40. In alternate embodiments, various other configurations and positions of the vent slot are provided within the scope of the invention. In this manner, the vent slot 70 provides a conduit for fluid communication for venting air to and from the contained volume 14, through the vent slot, and through spaces between the threads of the transfer lid 20 and the threads of the containment shell 12, to the ambient atmosphere external of the container 10.

Figure 6A:
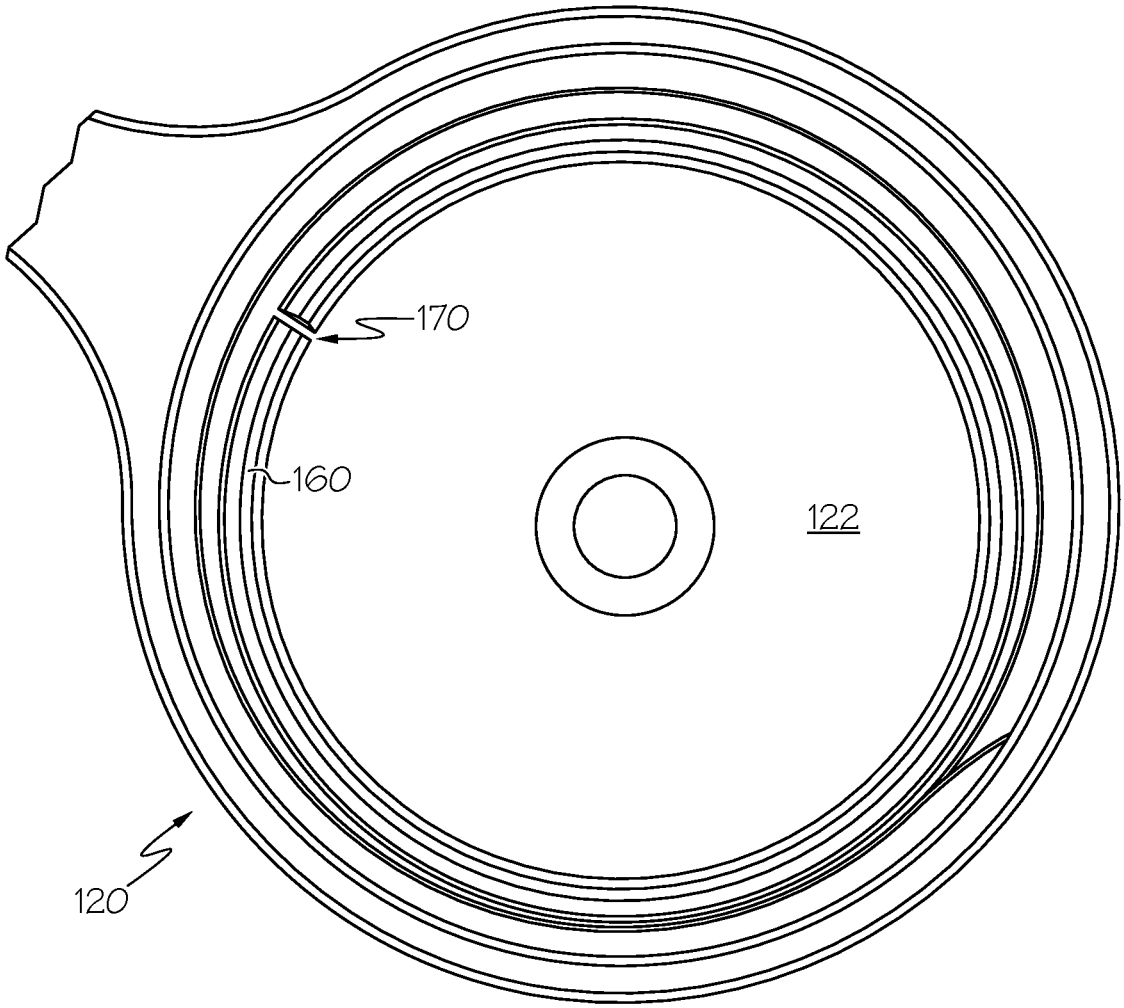
FIGS. 6A-C show a bottom view of a transfer lid according to another example embodiment of the present invention, and engagement of the lid interface with the bottle interface as the lid is closed onto the bottle.
Figure 6B:
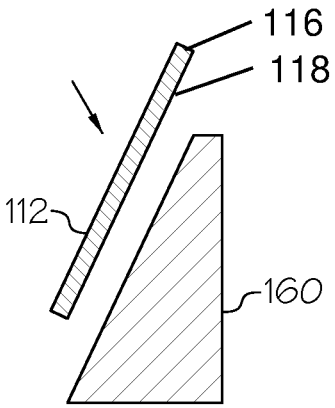
Figure 6C:
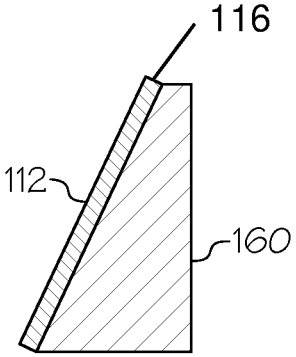

FIGS. 6A, 6B and 6C show a vented transfer lid 120 according to another embodiment of the invention, substantially similar to the above-described embodiment, with differences as noted. The lid 120 includes a top panel 120 with an inner collar 160 having a vent slot 170 extending therethrough. The inner collar 160 has a generally tapered or triangular cross-sectional profile, with an external taper angle generally corresponding to a confronting tapered contact face 118 of the rim 116 of the container shell 112. In this manner, partial closure of the transfer lid 120 onto the container shell allows clearance for venting (FIG. 6B), and further tightening of the transfer lid onto the container shell 112 engages the contact face of the inner collar 160 and the contact face 118 of the container shell 112 (FIG. 6C) to reduce or prevent venting, whereby selective control of the extent of closure allows a user to vary the extent of venting provided.

Figure 7A:
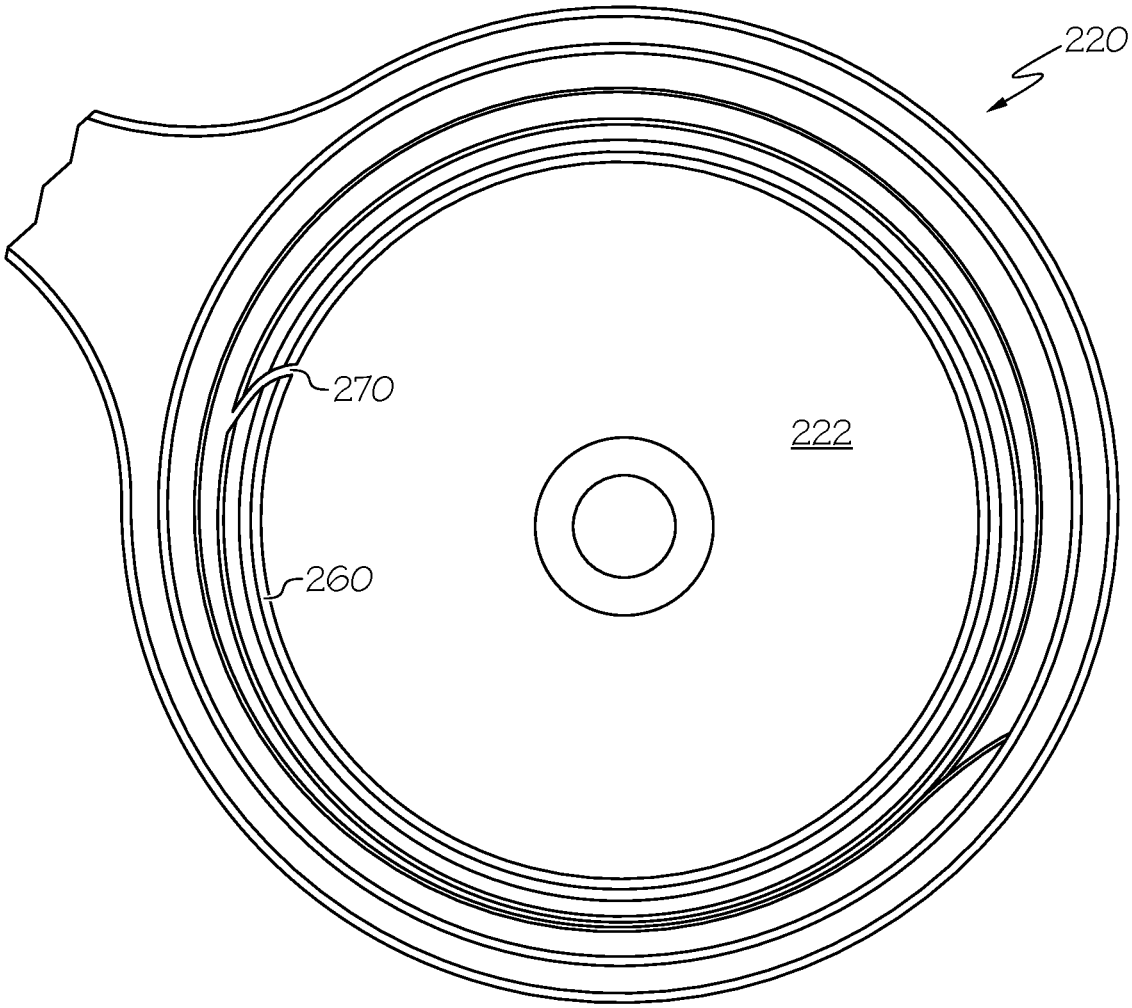
FIGS. 7A-C show a bottom view of a transfer lid according to another example embodiment of the present invention, and engagement of the lid interface with the bottle interface as the lid is closed onto the bottle.
Figure 7B:
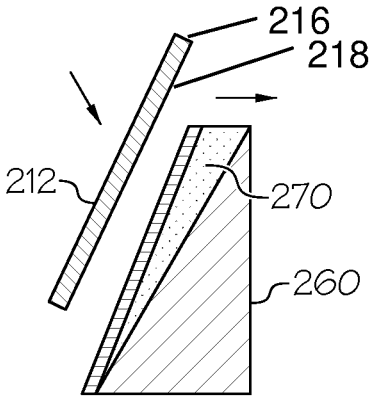
Figure 7C:
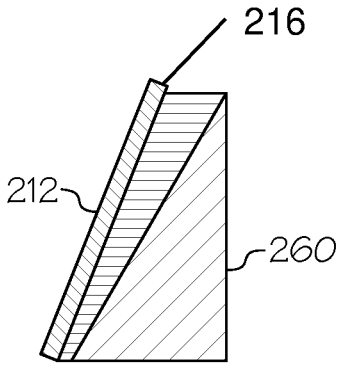

FIGS. 7A, 7B and 7C show a vented transfer lid 220 according to another embodiment of the invention. In this embodiment, the vent slot 270 extends through the inner collar 260 and along the top panel 222 of the transfer lid 220 in a non-radial direction. For example, the vent slot 270 may extend generally helically or along a chord of the circle defined by the top panel 222, rather than radially as in the above described embodiment. The outer face of the inner collar 260 preferably defines a tapered profile (see cross-section shown in FIG. 6A) having a steeper inclination than the confronting contact interface 218 of the rim 216 of the containment shell or bottle 212, and the inner collar 260 is flexible. In this manner, the vent slot 270 enables an "active" venting, as compared to the "passive" venting of the above described embodiments. When the transfer lid 220 is installed with a regular or normal installation force (i.e., the user screws the lid on with a light manual pressure until feeling a seating or contact), the inner collar 260 does not flex significantly and the vent slot 270 remains open to allow air passage sufficient to relieve pressure or vacuum resulting from transfer of liquid into or out of the container 212. When additional installation force is applied (i.e., the user screws the lid on more tightly with a higher manual force), the interface angles of the inner collar 260 and the rim 216 of the bottle 212 interact to cause the inner collar 260 to flex inwardly (see direction arrow in FIG. 7B, closing off the vent slot 270 to prevent airflow therethrough (see FIG. 7C). In this manner, the user may vary the installation pressure applied to the transfer lid 220 to selectively permit or prevent venting.

The invention further includes methods of collection, storage, transfer and delivery of fluids, for example enteral fluids such as breast milk, formula, medications, supplements and the like, using a container having a vented transfer lid. For example, a liquid is collected or deposited into a contained volume of the container, and a vented transfer lid as described herein is installed onto the container. In example embodiments, the container is a breast milk pump collection container, and the liquid is breast milk expressed by operation of the pump. Liquid can be transferred through a transfer port of the vented transfer lid, into or out of the contained volume, for example via a transfer syringe. In example embodiments, nutritional supplements and/or medication may be added to breast milk or formula in the container through the transfer port, and/or breast milk or formula may be withdrawn from the container into a syringe or other transfer device through the transfer port. Pressure or vacuum in the contained volume is released by venting air through a vent slot in the vented transfer lid. Optionally, a user selectively opens or closes the vent slot by controlled application of closure force used to engage the transfer lid with the containment shell.

While the invention has been described with reference to preferred and example embodiments, it will be understood by those skilled in the art that a variety of modifications, additions and deletions are within the scope of the invention, as defined by the following claims.

What is claimed is:

1. A transfer lid for use with a fluid container, the transfer lid comprising:

a top panel having a fluid transfer port for transferring fluid through the transfer lid to and from the fluid container;

an attachment collar extending downward from the top panel and configured for removably attaching the transfer lid to the fluid container;

an inner collar extending downward from the top panel and arranged generally concentrically with and spaced inwardly from the attachment collar, the inner collar having an inner surface, an outer surface, and a free lower end opposite from the top panel, the free lower end having a radiused profile extending from the inner surface to the outer surface that includes a bulb extending laterally outward from the free lower end to sealingly contact an inner surface of the fluid container and the free lower end being radiused or tapered to provide a smooth interface as the inner collar slides onto the fluid container, wherein the inner collar further includes a vent opening extending therethrough, wherein in use with the transfer lid attached to the fluid container, air can pass into and out of the fluid container by passing through the vent opening, but not past the sealingly contacting bulbous free lower end, of the inner collar.

2. The transfer lid of claim 1, wherein the vent opening comprises a vent slot.

3. The transfer lid of claim 1, wherein the vent opening extends generally radially through the inner collar.

4. The transfer lid of claim 1, wherein the vent opening extends non-radially through the inner collar.

5. The transfer lid of claim 4, wherein the non-radial vent opening comprises an active vent allowing a user to selectively open and close the vent opening.

6. The transfer lid of claim 1, wherein the inner collar comprises a tapered contact face for engagement with the fluid container.

7. The transfer lid of claim 1, wherein the fluid container comprises a breast milk pump collection container having an externally threaded rim, and wherein the attachment collar of the transfer lid comprises internal threads compatible with the externally threaded rim of the breast milk pump collection container.

8. The transfer lid of claim 1, wherein the fluid transfer port comprises an enteral-only coupling.

9. The transfer lid of claim 1, further comprising a port closure cap for closure of the fluid transfer port.

10. The transfer lid of claim 9, wherein the port closure cap is attached to the transfer lid by a tether.

11. The transfer lid of claim 1, wherein the vent opening includes a vent slot extending through the inner collar and extending radially along the inner surface of the top panel from an inner surface of the inner collar to an outer surface of the inner collar.

12. A fluid containment and transfer system comprising:

a containment shell defining a contained volume therein and having a rim defining an opening for accessing the contained volume and defining an angled inner circumferential contact face opposite an angled outer circumferential contact face, the containment shell comprising a threaded coupling on the outer circumferential contact face around the opening; and a transfer lid comprising a top panel, an attachment collar extending downward therefrom and configured with helical threads for releasable engagement with the threaded coupling of the outer circumferential contact face of the containment shell to allow attachment and removal of the transfer lid from the containment shell, an inner collar extending downward therefrom and arranged generally concentrically with and spaced inwardly from the attachment collar, a vent slot extending through at least a portion of the inner collar from an inner surface to a tapered contact face configured for engagement with the angled inner circumferential contact face of the containment shell rim, and a fluid transfer port through the top panel for transfer of fluid through the transfer lid into and out of the contained volume of the containment shell, wherein the inner collar is flexible, and the tapered contact face of the inner collar has a steeper taper angle than an angle of the angled inner circumferential contactface of the containment shell rim, such that partial closure of the transfer lid onto the containmentshell allows clearance for venting, and wherein furthertightening of the transfer lid onto the containment shell closes the vent slot to prevent venting.

13. The fluid containment and transfer system of claim 12, wherein the containmentshell comprises a breast milk pump collection container having an externally threaded rim, and wherein the attachment collar of the transfer lid comprises internal threads compatible with the externally threaded rim of the breast milk pump collection container.

14. The fluid containment and transfer system of claim 12, wherein the vent slot extends generally radially through the inner collar.

15. The fluid containment and transfer system of claim 12, wherein the vent slot extends non-radially through the inner collar.

16. The fluid containment and transfer system of claim 12, wherein the fluid transfer port comprises an enteral-only coupling.

17. The fluid containment and transfer system of claim 12, wherein the transfer lid further comprises a port closure cap for closure of the fluid transfer port.

18. The fluid containment and transfer system of claim 17, wherein the port closure cap is attached to the transfer lid by a tether.

19. A breast milk containment and transfer system comprising:

a breast milk pump collection container having a rim with an angled inner circumferential contactface and threads along an outer circumferential contact face, the container defining a contained volume; and a transfer lid comprising a top panel, an attachment collar extending downward from the top panel and configured for releasable engagement with the rim threads of the breast milk pump collection container to allow attachment and removal of the transfer lid from the breast milk pump collection container, an inner collar extending downward from the top panel and arranged generally concentrically with and spaced inwardly from the attachment collar, the inner collar further comprising an inner surface, an outer surface, and a vent slot extending through at least a portion of the inner collar, and a fluid transfer port through the top panel for transfer of fluid through the transfer lid into and out of the contained volume of the breast milk pump collection container, wherein the inner collar has a radiused free lower end opposite from the top panel, the radiused free lower end extending from the inner surface to the outer surface of the inner collar and having a profile that includes a bulb extending laterally outward from of the free lower end to sealingly contact an inner surface of the container and that is radiused or tapered to provide a smooth interface as the inner collar slides onto the container, wherein in use with the transfer lid attached to the container, air can pass into and out of the container by passing through the vent slot, but not past the sealingly contacting bulbous free lower end, of the inner collar, and wherein the inner collar is flexible and includes a tapered contact face for engagementwith the angled inner circumferential contactface of the container rim, and the tapered contact face of the inner collar has a steeper inclination than the angled inner circumferential contactface of the container rim, such that selective control of the extent of closure of the attachment collar of the transfer lid with the threaded rim of the breast milk pump collection container is configured such that the extent of venting can be varied between a vented configuration and a non-vented configuration.

* * * * *